US009611092B2

(12) United States Patent
Ditzler

(10) Patent No.: US 9,611,092 B2
(45) Date of Patent: Apr. 4, 2017

(54) RECYCLING INFORMATION TOOL

(71) Applicant: Benjamin Ditzler, Philadelphia, PA (US)

(72) Inventor: Benjamin Ditzler, Philadelphia, PA (US)

( * ) Notice: Subject to any disclaimer, the term of this patent is extended or adjusted under 35 U.S.C. 154(b) by 0 days.

(21) Appl. No.: 15/151,029

(22) Filed: May 10, 2016

(65) Prior Publication Data

US 2016/0251158 A1 Sep. 1, 2016

Related U.S. Application Data

(63) Continuation-in-part of application No. 14/611,595, filed on Feb. 2, 2015, now Pat. No. 9,334,110.

(60) Provisional application No. 61/934,789, filed on Feb. 2, 2014.

(51) Int. Cl.

| | |
|---|---|
| ***B65D 25/04*** | (2006.01) |
| ***B65F 1/00*** | (2006.01) |
| ***B65F 1/16*** | (2006.01) |

(52) U.S. Cl.

CPC ..... *B65F 1/004* (2013.01); *B65F 1/1607* (2013.01); *B65F 2210/112* (2013.01); *B65F 2210/1128* (2013.01)

(58) Field of Classification Search

CPC ..... B65F 1/00; B65F 1/04; B65F 1/06; B65F 1/068; B65F 1/12; B65F 1/16; B65F 1/1615; B65F 2001/1653; B65F 2001/1669

USPC ..... 220/495.06, 495.08, 495.11, 495.07, 220/495.01, 737, 908, 908.1; 206/390, 206/554, 555

See application file for complete search history.

(56) References Cited

U.S. PATENT DOCUMENTS

| | | | | |
|---|---|---|---|---|
| 1,703,157 | A * | 2/1929 | Lima | B65D 43/00 160/219 |
| 4,905,853 | A * | 3/1990 | Strawder | B65F 1/06 220/23.83 |
| D345,239 | S | 3/1994 | Cooper | |
| 5,465,841 | A * | 11/1995 | Wilson | A61M 5/3278 206/366 |
| 6,378,721 | B1 * | 4/2002 | Williams | B65F 1/0006 220/495.08 |
| 8,555,781 | B1 * | 10/2013 | Garcia | B30B 9/3092 100/223 |
| 9,334,110 | B2 * | 5/2016 | Ditzler | B65F 1/1607 |
| 2007/0228046 | A1 | 10/2007 | Bastioli et al. | |
| 2009/0199723 | A1 * | 8/2009 | Veltrop | A47J 37/0623 99/427 |
| 2012/0298667 | A1 * | 11/2012 | Anthony | B65D 43/0208 220/287 |

OTHER PUBLICATIONS

Lucy Glib, "Yes I Can (In Which I Fear the Wrath of Greenpeace), " Neurotic City Sep. 22, 2011.

* cited by examiner

*Primary Examiner* — Steven A. Reynolds
*Assistant Examiner* — Javier A Pagan
(74) *Attorney, Agent, or Firm* — Spruce Law Group, LLC

(57) ABSTRACT

A recycling receptacle provides a physical example of items to be recycled as part of a recycling receptacle. The recycling receptacle includes a container portion for storing material to be recycled in a chamber and a communication portion for communicating what material should be recycled. The communication portion includes an opening in fluid communication with the container portion chamber and a visible cell that contains examples of materials that should be recycled.

19 Claims, 11 Drawing Sheets

RECYCLING INFORMATION TOOL

BACKGROUND

In the last 20 years, recycling has evolved from can and bottle store returns to a widely accepted and participated-in practice. Now, material recovery facilities sort and process recyclables, municipalities distribute special receptacles for collecting recycling, and manufactured products are marketed as recycled in order to gain competitive advantage.

In the United States alone, 33% of waste is recycled, which corresponds to over 80 million tons of waste. Daily, this accounts for over 1.5 pounds of recycled waste per person per day.

Despite widespread recycling, it can be confusing to would-be recyclers because different geographic areas handle waste materials differently. Some areas recycle certain plastics but not others. Some accept all recyclable materials in a single stream and sort them for later processing. Some require that certain recycled products be separated from others. Some exclude specific products from being recycled.

There are a lot of recycling rules and if a recycler is familiar with the material rules, a recycler only knows the recycling rules for their own town. Thus, when they approach a recycling receptacle in a public place, they face a confusing choice because not every recycling receptacle has a descriptive label beyond "recycling." And even those that are labeled are often just labeled with a graphic of a bottle or newspaper, with no differentiator between other types of recyclable materials. The would-be recycler may not know if the receptacle accepts glass or plastic, or whether it accepts clear plastic or pigmented. The answers to those questions depend on local recycling regulations and existing recycling facilities.

The current apparatus seeks to solve these problems in an easy-to-use and straightforward way.

SUMMARY OF THE EMBODIMENTS

The recycling receptacle described herein addresses these problems by providing physical examples of items to be recycled as part of a waste receptacle. The receptacle includes a container portion for storing material to be recycled in a chamber and a communication portion for communicating what material should be recycled, composted, or otherwise disposed of. The communication portion includes an opening in fluid communication with the container portion chamber and a visible cell that contains examples of materials that should be placed in the container.

DETAILED DESCRIPTION OF THE EMBODIMENTS

Figure 1A:
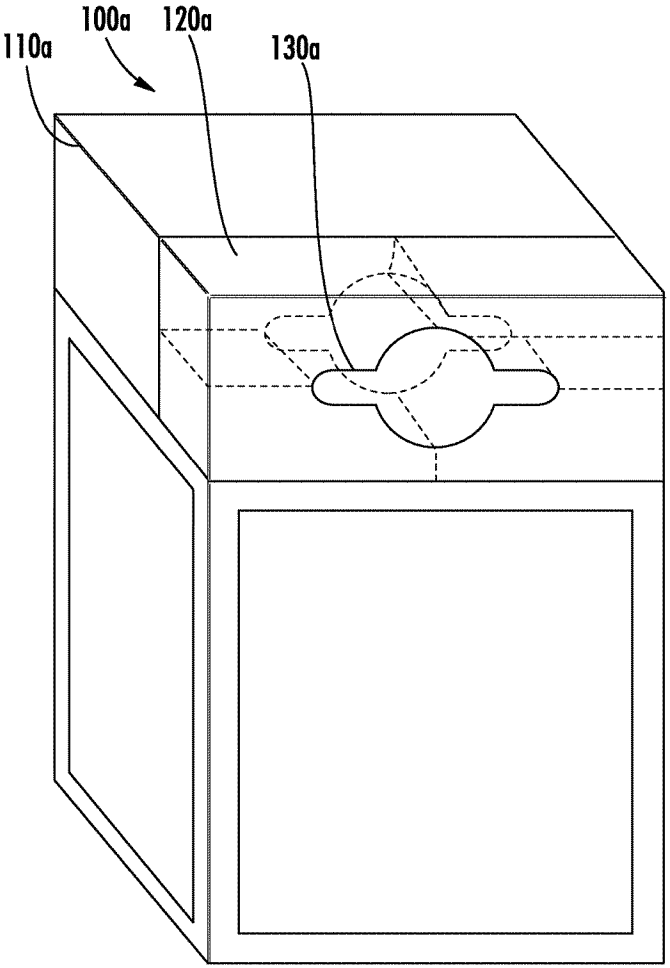
FIG. 1*a* shows a perspective view of an alternate embodiment of the receptacle.
Figure 1:
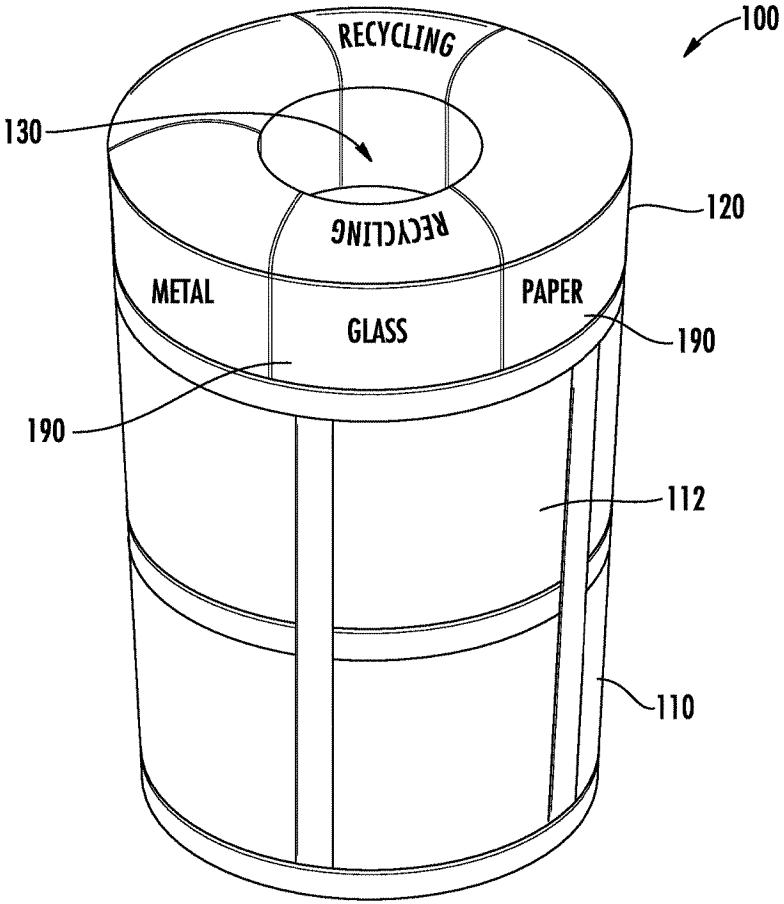
FIG. 1 shows a perspective view of one embodiment of the receptacle.
Figure 2:
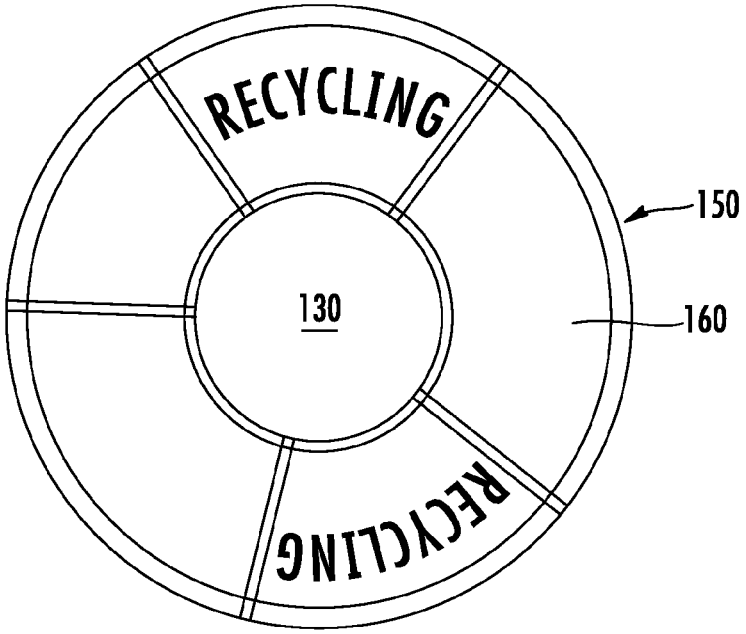
FIG. 2 shows a top view of the receptacle of FIG. 1.
Figure 3:
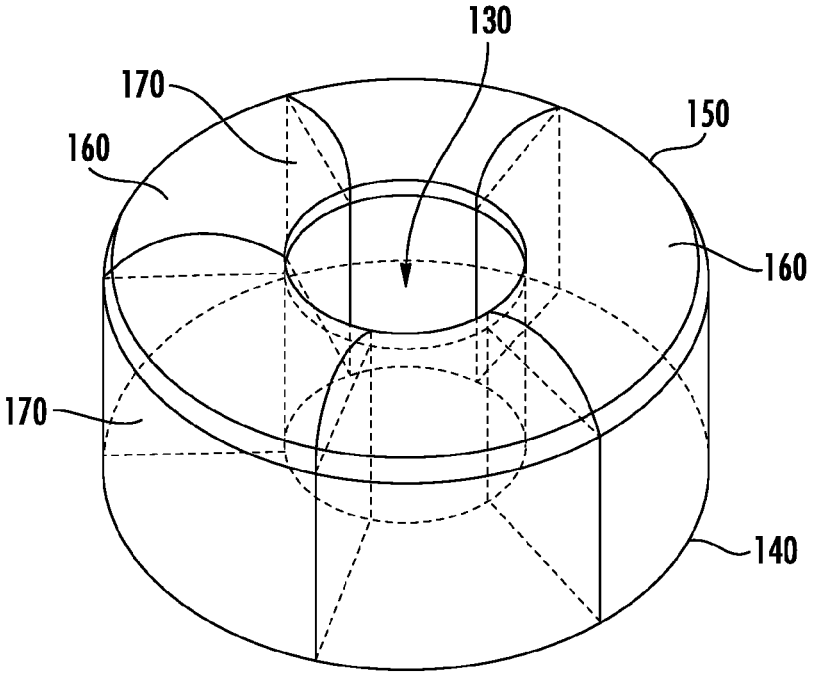
FIG. 3 shows a perspective view of a portion of the receptacle of FIG. 1.

FIGS. 1-4*a* show an overview of one embodiment of the receptacle. As shown, a receptacle 100 comprises a container portion 110 and a communication portion 120. The container portion 110 provides an open cavity 112 for receiving and storing recyclable materials placed in the receptacle 100. The container portion 110 may be subdivided into more chambers 112 to receive multiple recycling streams but as shown in FIGS. 1-4*a*, the container portion 110 has only one chamber 112. Although most of the examples herein are discussed in the context of recycling, the container 100 could also be used for composting, separating waste streams, and disposing of hazardous materials.

The communication portion 120 may be made from a see-through material (like a transparent UV-resistant polymer) and has at least one opening 130 that is in fluid communication with the chamber 112 for receiving recyclable materials. Recyclable materials deposited into the opening 130 fall into the chamber 112 for later collection. To prevent pests and odors, the opening 130 may have flaps, a hinged door, or other easily removable obstacle.

While the communication portion 120's lid 150 may be transparent, the base 140 may be opaque. The advantage of the base portion 140 being opaque is that it blocks the view of the waste in the container portion 110, which some people or businesses may find distasteful. The opacity of the base 140 may be achieved through (1) an opaque material choice for the base, (2) painting or dying the base 140, (3) lining the base 140's interior to prevent seeing the waste. An opaque base 140 may also better integrate into the appearance of the container portion 110, and also make for better viewing of the objects therein.

Figure 4:
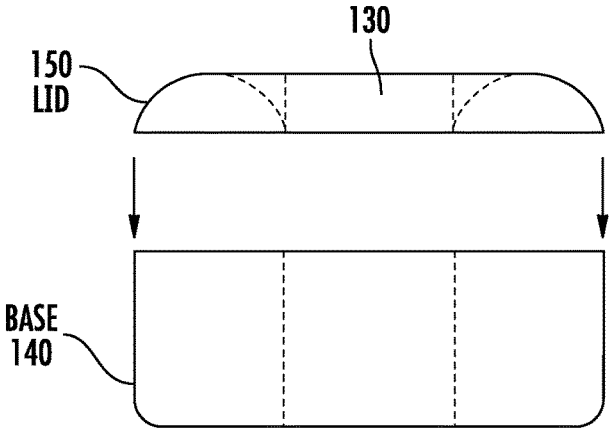
FIG. 4 shows an exploded side elevation view of the portion of FIG. 3.
Figure 4A:
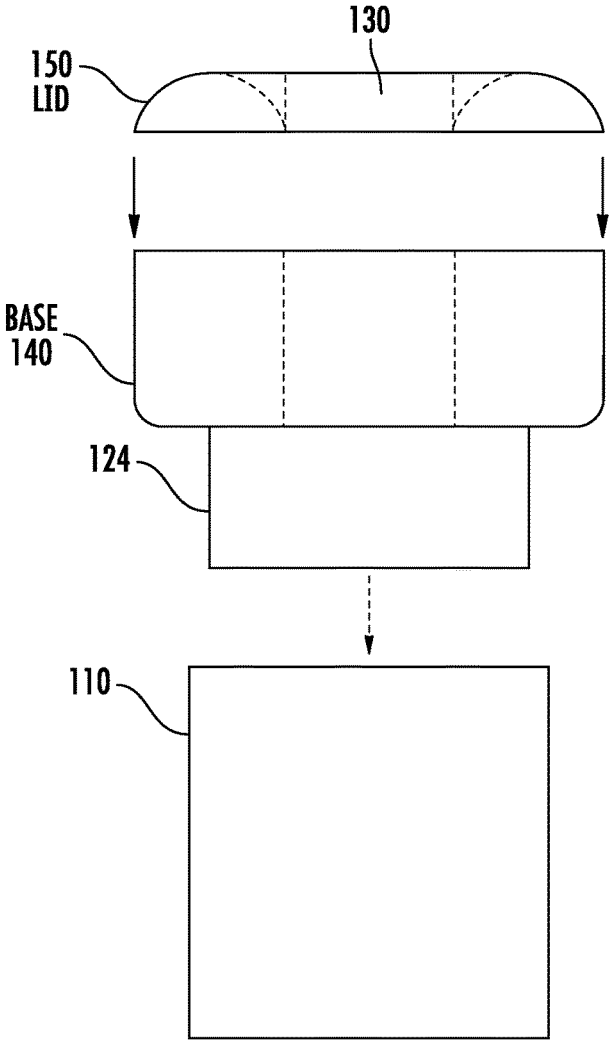
FIG. 4*a* shows a variation of the exploded side elevation view of the portion of FIG. 4.

The container portion 110 and communication portion 120 may be connected or removable from one another, but as shown in FIGS. 1-4*a*, they are removable from one another. When collecting recyclable materials from the chamber 112, the communication portion 120 may be moved out of the way to better access the chamber 112. As shown in FIG. 4*a*, the communication portion 120 includes a flange 124 that extends from the communication portion 120 and engages the container portion 110's interior surface. The engagement may be a press fit, threaded, or use attachment means like screws or bolts.

The communication portion 120 defines a cavity and may have two parts, a base 140 and a lid 150 that generally bound the bottom and top of the communication portion 120 respectively. The base 140 and lid 150 may be attached to one another in a press fit, screw fit, or other attachment, including a locking attachment to prevent unauthorized manipulation of the base 140 and lid 150. The base 140 and lid 150 define a cavity that is further subdivided into cells 160 separated by cell dividers 170.

The cells 160 may hold examples of the types of items that can be recycled. Thus, a recycler who approaches a receptacle with a clear plastic water bottle and a white plastic yogurt container can quickly scan the items in the cells 160 to determine if the item being disposed of is acceptable. The communication portion 120 thus serves as both a lid to the container portion 110 and a means of communicating what is accepted for recycling.

The different cells 160 serve to group like items. Thus, one cell may contain different kinds of clear plastics that are acceptable while another may contain white plastics. Alternatively, one cell 160 may contain bottles and liquid containers while another contains paper and cardboard. The organization of what is in each cell 160 would be up to the manager of the recycling receptacle 100.

The cells 160 and their contents' effectiveness may be enhanced with labels 190 like METAL, GLASS, PAPER, etc. The combination of the labels and example products will help a recycler who approaches a recycling receptacle 100 decide what should be placed therein.

FIG. 1*a* shows a variation of FIGS. 1-4 where the opening 130*a* and communication portion 120*a* are oriented vertically, which may be advantageous to prevent the ingress of water (from rain) or other items falling into the receptacle 100*a* container portion 110*a*.

Figure 5:
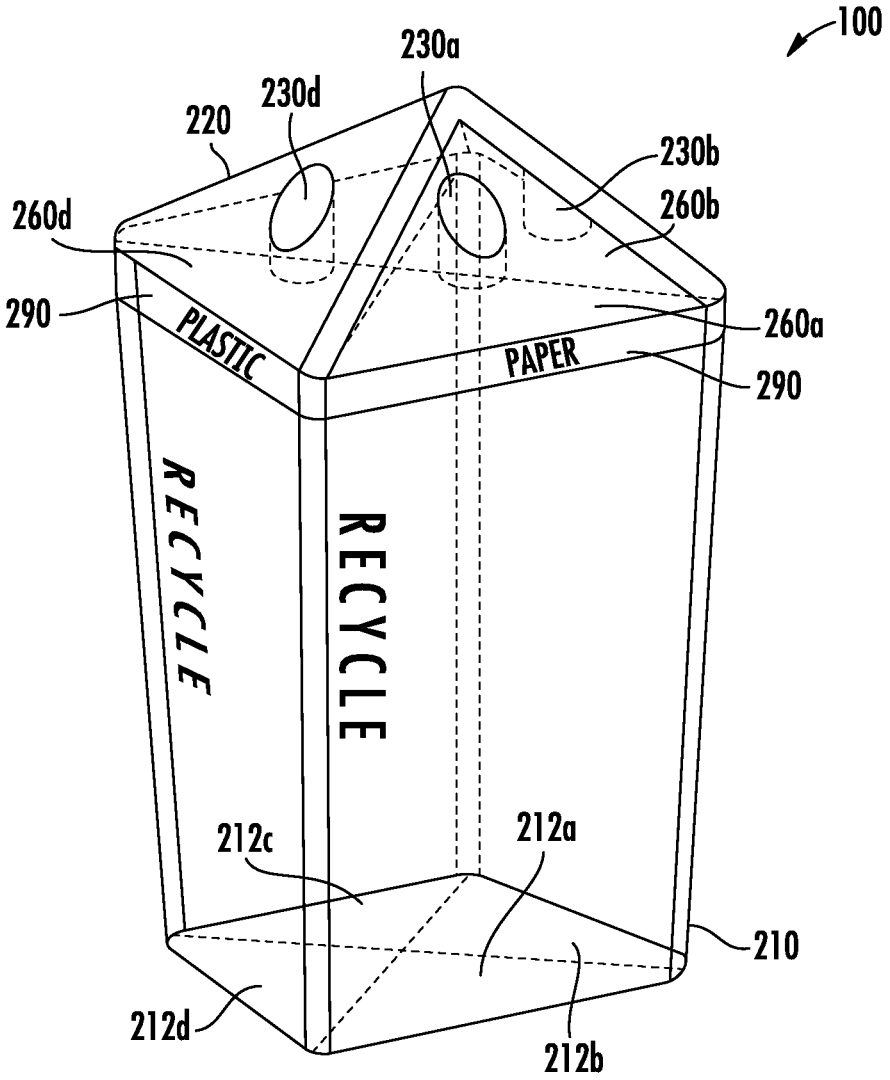
FIG. 5 shows a perspective view of a second embodiment of the receptacle.

FIG. 5 shows an alternate embodiment for multi-stream recycling where different recycling streams must be separated. Thus, instead of one chamber 112, the container 200's container portion 220 has separate chambers 212*a*, 212*b*, 212*c*, and 212*d*—one for each recycling type stream. The chambers 212*a*, 212*b*, 212*c*, and 212*d* are in fluid communication with the openings 230*a*, 230*b*, and 230*d* (the opening that would be 230*c* cannot be seen in FIG. 2) in the communication portion 220.

The communication portion 220's cells 260*a*, 260*b*, 260*d*, as shown, surround their corresponding openings 230*a*, 230*b*, 230*d*. In use, each cell could be filled with example recyclables, thus communicating to a recycler the type of product that should be inserted into each corresponding opening.

Similar to the embodiment shown in FIGS. 1-4*a*, the communication portion 220 may have labels 290, and the communication portion 220 could be removable from the container portion 210.

The communication portion 120, 220 may be a single item that can be retrofitted to an existing container size, which reduces the cost of distributing the entire receptacle since the container portion 110 can be reused.

In either embodiment, the shape of the communication portion 120, 220 is not fixed and may be round, polygonal, hemispherical, pyramidic, prismatic, etc.

The lid 150 and base 140 may be separable or connected, as long as the cells 160 are accessible. The lid 150 and base 140 may be secured together by a lock or, after insertion of recycling example items, permanently sealed. The lid 150 and/or base 140 may have holes 142 to help ventilate the cells 160 or be sealed to prevent outside contamination. The lid 150 may overlap the base to prevent water from entering the cells 160.

Although in the examples shown, the receptacle is shown as top loading, a front loading receptacle is also possible, the advantage being that water will not enter the receptacle as easily.

Figure 6:
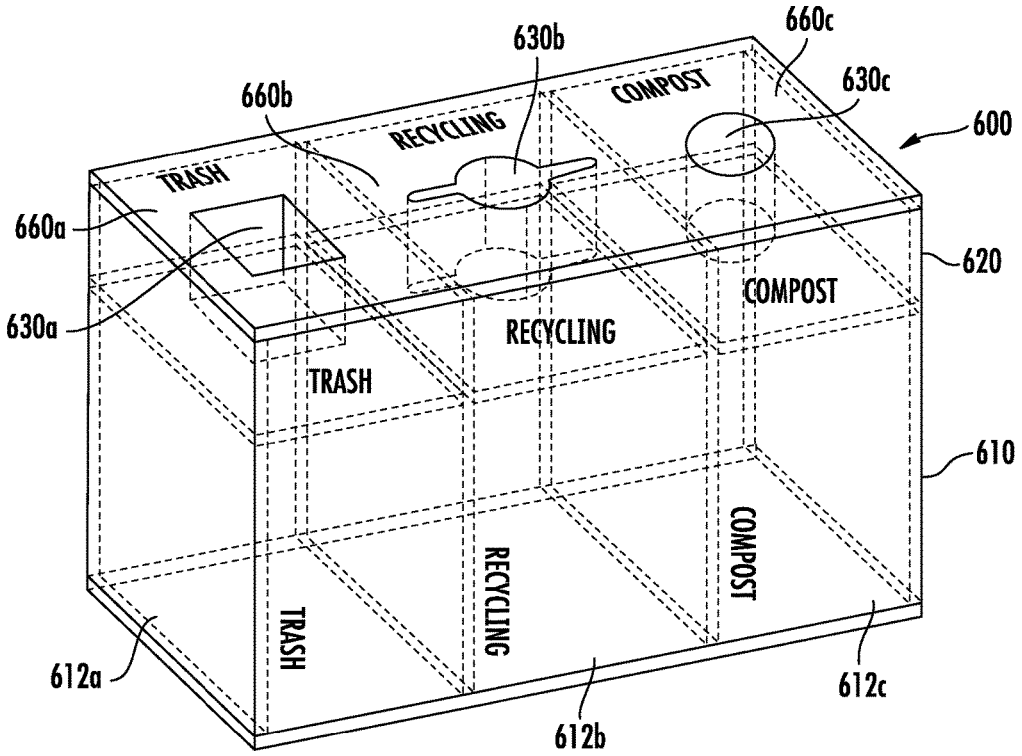
FIG. 6 shows a perspective view of a third embodiment of the receptacle.

FIG. 6 shows a third alternate embodiment receptacle 600. Although the other receptacles have been shown in the context of recyclable materials, receptacles could also be used, as discussed above, as trash and/or composting bins. Examples of trash and compost waste might need to be shown, at times, in model form instead of using actual waste, in order avoid odors, pests, and biodegradation. In such a receptacle 600, a container portion 610 and communication portion 620 define the receptacle 600. The container portion 610 may comprise chambers 612*a*, 612*b*, and 612*c* for trash, recycling, and compost respectively. The communication portion 620 is similar in that it defines a cavity for storing example materials in separate chambers 660*a*, 660*b*, and 660*c*. The cavities 660*a*, 660*b*, and 660*c* surround an opening 630*a*, 630*b*, and 630*c* that allows waste, recyclables, or compost to pass into the chambers 612*a*, 612*b*, and 612*c*.

The receptacle could also be used for advertising, by either placing advertisements on the receptacle, or stocking recyclable examples in the cells that not only communicate recycling types but also serve as advertisements. Thus, a person might see a multi-stream communication portion for glass, metal, plastic and paper, and in each cell, a corresponding Coca-Cola® product demonstrates the proper items for recycling.

Another embodiment of the receptacle could be located, and branded for specific locations showing examples of recyclable, compostable and trash-able materials from that location. Thus, a receptacle in a Starbucks could have examples for types of waste materials generated from that Starbucks. The recycling examples in the communications portion could also serve the purpose of letting the public know that the example products are recyclable or compostable, which capitalizes on the goodwill generated from letting the public know that the example products are recyclable or compostable.

Figure 7:
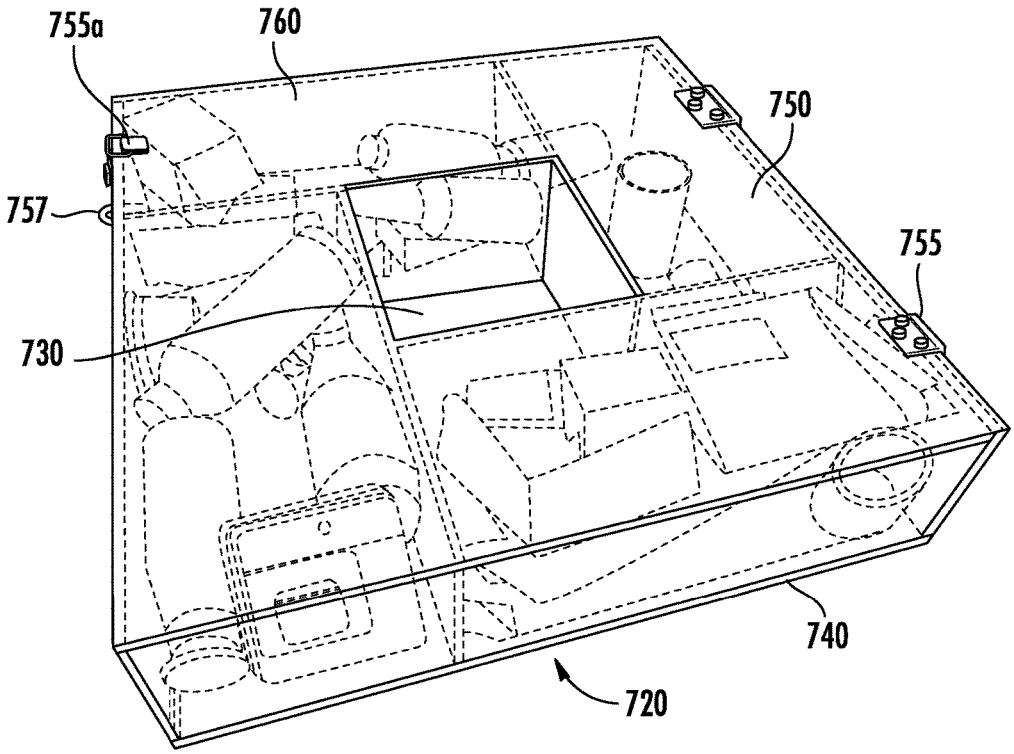
FIG. 7 shows different views of a communications portion of the receptacle.

FIG. 7 shows another embodiment wherein the communication portion 720 has an opening 730, a lid 750 hingedly connected to a base 740 through a hinge 755. The base 740 includes cells 760, and the base 740 is secured to the lid 750 using an openable lock 757. Instead of hinges 755, clips, latches or other non-permanent connections 755*a* could be possible to connect the lid 750 and base 740.

Figure 8:
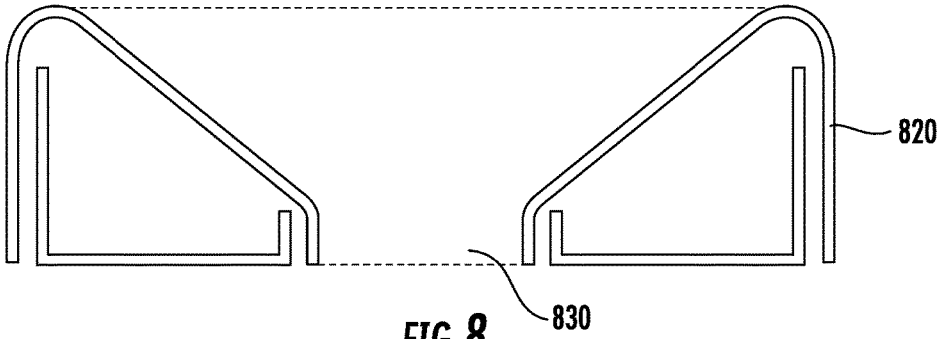
FIG. 8 shows a cross section of an alternate embodiment of the receptacle.

FIG. 8 shows a lid 820 that wraps around the entire top and outside of a receptacle for ease of removal for cleaning. The lid has a funnel shape to its opening 830 that directs materials into a container portion.

Figure 9:
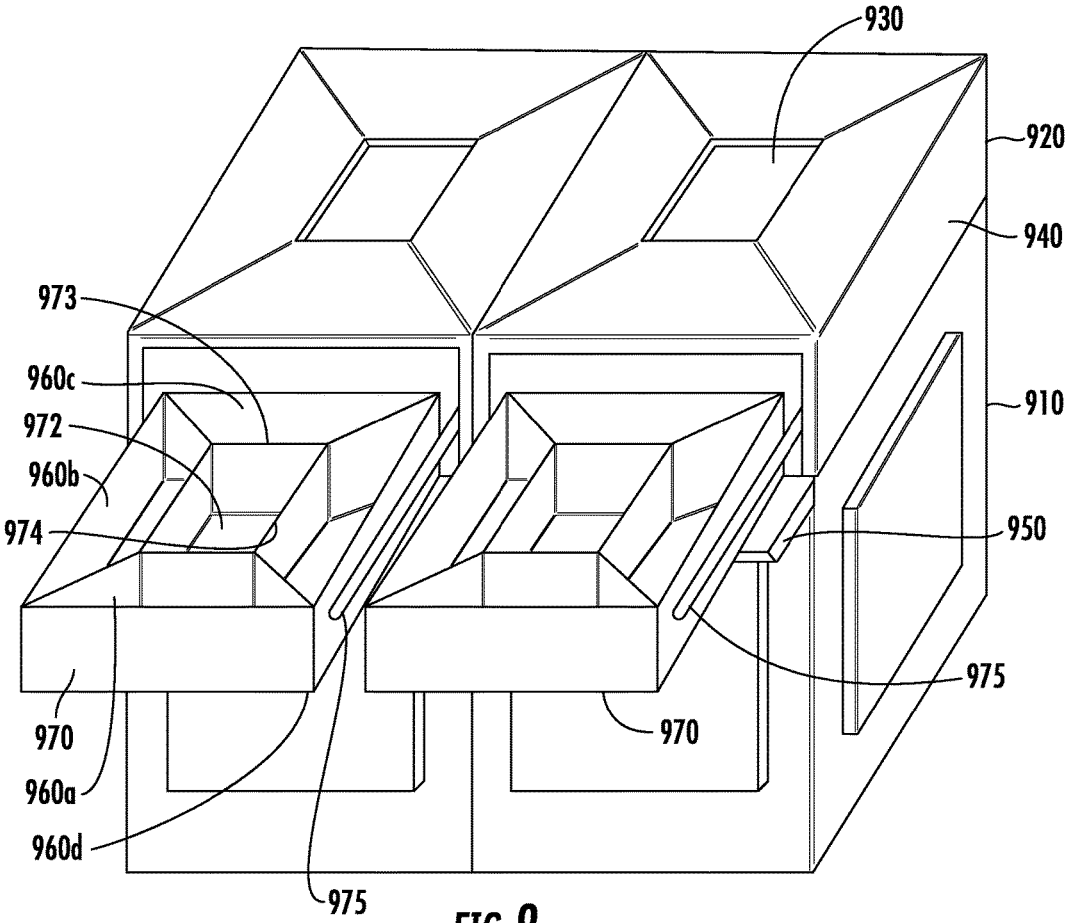
FIG. 9 shows an alternate embodiment of the communications portion having a sliding drawer.

FIG. 9 shows another embodiment where the communication portion 920 has an opening 930 and door 950 connected to a base 940, which itself engages a container portion 910. With the door 950 open, a user may remove a communication tray 970 that defines chambers 960*a*, 960*b*, 960*c*, and 960*d*. The communication tray 970 may slide from the communication portion 920 as a drawer on a roller and slide mechanism 975. The communications tray 970 includes an opening 972 that extends therethrough and joins the opening 930 with the container portion 910 such that items for disposal pass into the container portion 910. Edges 973 around the communications tray opening 972 may be sealed with a bubble seal, brush seal, or other seal 974 to ensure items for disposal do not pass into the chambers 960*a*, 960*b*, 960*c*, and 960*d*.

Figure 10:
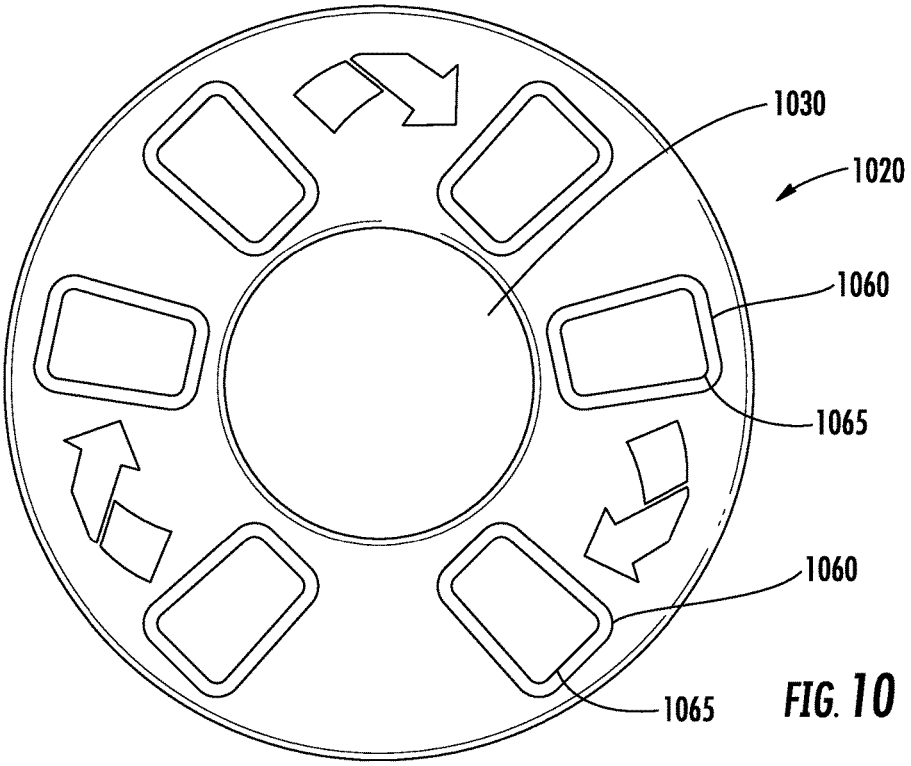
FIGS. 10 and 11 show alternate embodiments of the communications portion having preformed cavities.
Figure 11:
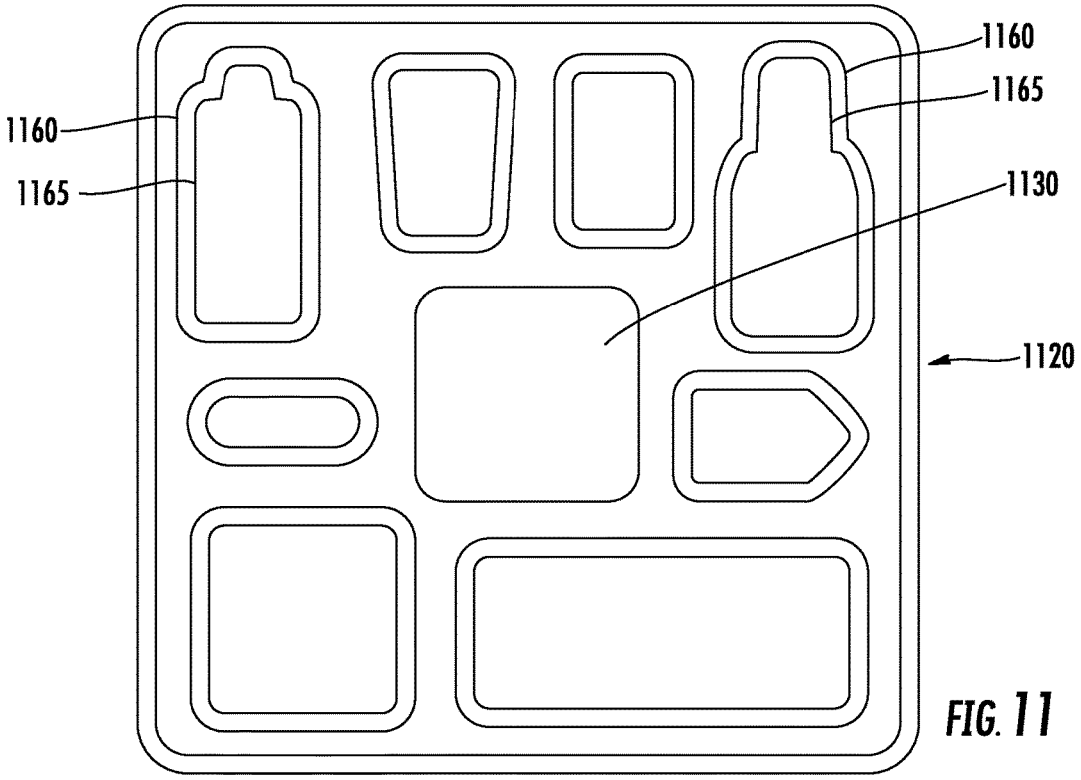

FIGS. 10 and 11 show different shaped embodiments of a communication portion 1020 and 1120. Both have openings 1030, 1130 that connect to a container portion (not shown in these figures). The communication portion 1020, 1120 has shaped cavities 1060, 1160 that can accept like-shaped items 1065, 1165 to show users what items are to be disposed of. If the communication portion 1020, 1120 was formed as one piece of a two-part insertable and removable tray, it could be occasionally replaced or easily cleaned.

Figure 12:
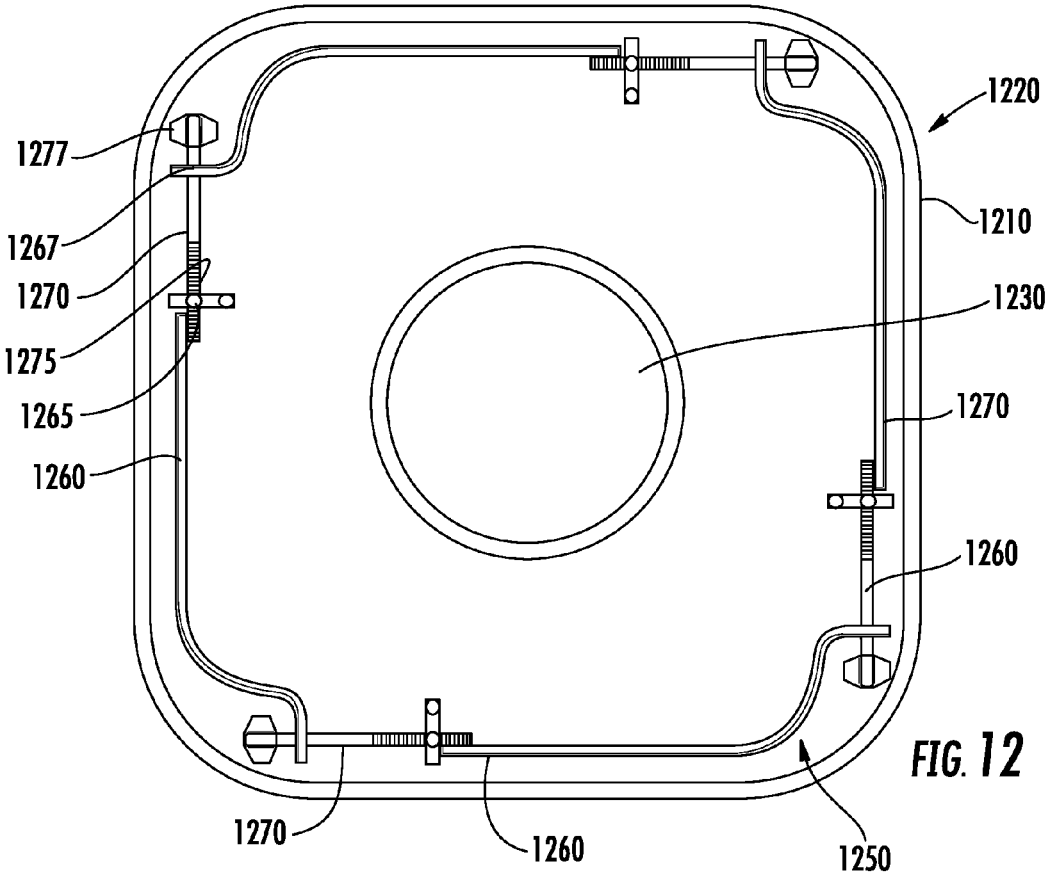
FIGS. 12-14 show alternate embodiments of the communication portion for sizing to different containers.
Figure 13:
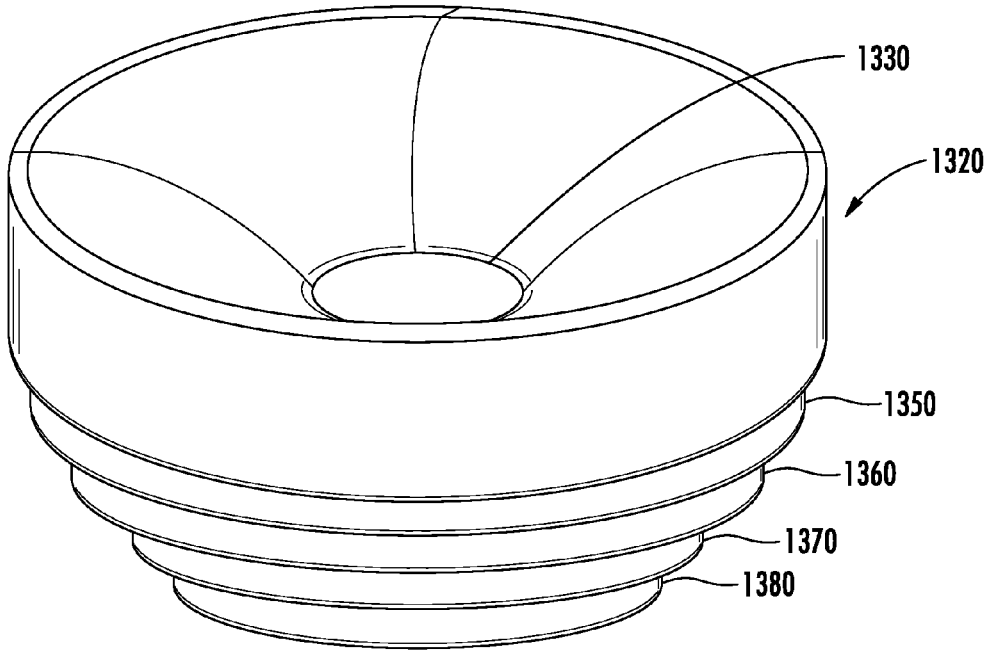
Figure 14:
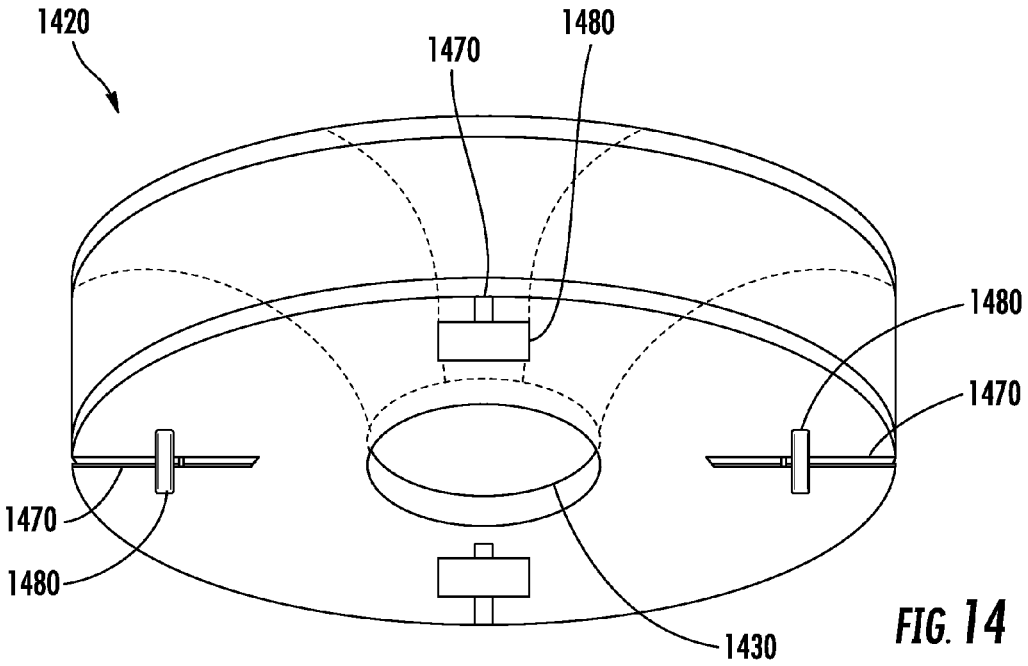

FIGS. 12-14 show embodiments of communication portions 1220, 1320, and 1420 that can fit multiple size containers. FIG. 12 shows a communications portion 1220 with an opening 1230 therethrough from its underside. The communications portion has an adjustment mechanism 1250 comprising linked engagement arms 1260 and bolts 1270. The bolt threading 1275 engages the arm threading 1265 and the bolt head 1277 engages a the arm 1260 at a through hole 1267, such that when the bolts 1270 are loosened, the arms 1260 extend outwards to engages a container 1210. This allows for easy installation onto many sized containers. The arms 1260 may alternatively work to clamp the outside of a container.

FIG. 13 shows an alternate communication portion 1320 with opening 1330. The communication portion 1320 has different diameter concentric rings 1350, 1360, 1370, 1380. Each ring may be pre-sized to certain dimensions that would fit standard container proportions.

FIG. 14 shows an alternate communication portion 1420 with an opening 1430 therethrough. The communication portion has tracks 1470 with tabs 1480 extending therefrom and downwards. The tabs 1480 move along the track 1470 and engage a container portion (not shown) of different sizes.

Figure 15:
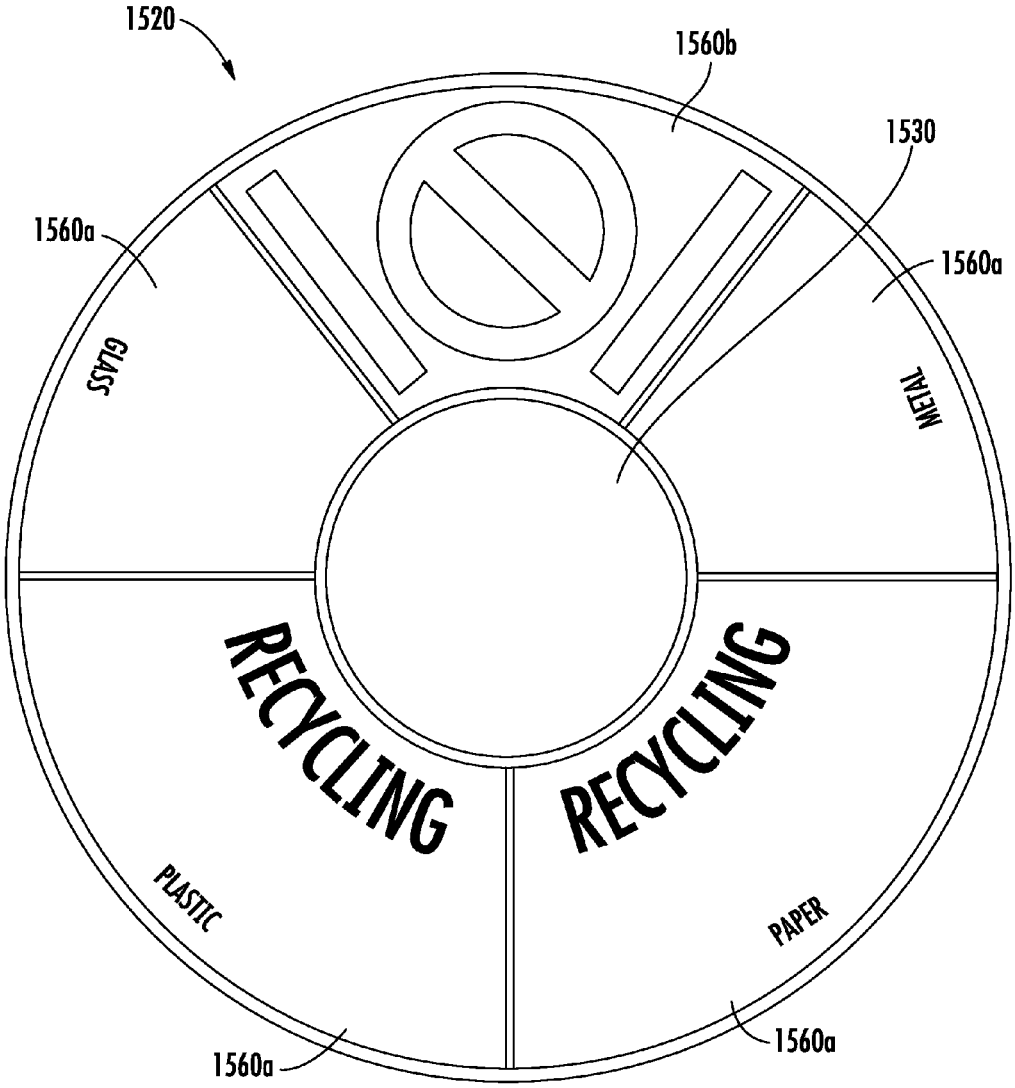
FIG. 15 shows an alternate embodiment of the communications portion.

FIG. 15 shows an alternate communications portion 1520 with an opening 1530 and chambers 1560*a*. Chamber 1560*b* is a transparent chamber with a label notifying users of what not to dispose of in the receptacle.

The communication portion may comprise a side sleeve for messaging/advertisements.

The communication chambers may also hold example items to be recycled and examples of new materials that items become, for example, a plastic PET bottle can be in one compartment, and a sample of fleece cloth can be in the following compartment (indicated by the arrow in FIG. 10) showing that the PET is recycled into fleece. The communication chambers may also indicate types of materials not to recycle.

While the invention has been described with reference to the embodiments above, a person of ordinary skill in the art would understand that various changes or modifications may be made thereto without departing from the scope of the claims.

I claim:

1. A receptacle comprises:

a container portion defining a chamber for storing material to be disposed of in the chamber;

a communication portion for communicating what material should be disposed of, the communication portion comprising:

an opening in fluid communication with the container portion chamber; and a visible cavity surrounding the opening, wherein the visible cavity holds examples of materials that should be disposed of.

2. The receptacle of claim 1, wherein the cavity is divided into separable cells.

3. The receptacle of claim 1, wherein the cavity is divided into separable cells, wherein each separate cell is shaped to accept like-shaped items.

4. The receptacle of claim 1, wherein the communications portion is adapted to fit multiple sizes of the container portion.

5. The receptacle of claim 4, wherein the lid and the base are joined using a non-permanent connection.

6. The receptacle of claim 1, wherein the opening is removably sealable.

7. The receptacle of claim 1 wherein the communication portion and container portion are engaged to one another via a flange.

8. The receptacle of claim 7, wherein the flange engages an interior surface of the container portion.

9. The receptacle of claim 1, wherein the communication portion further comprises a base and a lid, wherein the lid wraps around a top of the receptacle portion.

10. The receptacle of claim 1, wherein the communications portion comprises an opening and a door, wherein within the door comprises a communication tray that is removable and contains the examples of material to be disposed of.

11. The receptacle of claim 10, wherein the communication tray slides from the communication portion on a roller and slide mechanism.

12. The receptacle of claim 10, wherein the communications tray includes a communications tray opening that aligns with the opening.

13. The receptacle of claim 1, wherein the cavity is divided into separable cells, wherein each separate cell is shaped to accept like-shaped items.

14. The receptacle of claim 1, wherein the communications portion is adapted to fit multiple sizes of container portions.

15. A receptacle communication portion comprising:

a communication portion for communicating what material should be disposed of in a receptacle, the communication portion comprising:

an opening therethrough; and a visible cavity surrounding the opening, wherein the visible cavity holds examples of materials that should be disposed of.

16. The communication portion of claim 15, wherein the communication portion is adapted to fit multiple sizes of container portions.

17. The receptacle of claim 15, wherein the communication portion comprises an adjustment mechanism that can clamp onto a container portion.

18. The receptacle of claim 15, wherein the communication portion comprises multiple diameter concentric rings extending therefrom that engage the container portion.

19. The receptacle of claim 15, wherein the communication portion comprises tracks with tabs extending therefrom to engage the container portion.

* * * * *